US007419616B2

(12) United States Patent
Ulicny et al.

(10) Patent No.: US 7,419,616 B2
(45) Date of Patent: Sep. 2, 2008

(54) MAGNETORHEOLOGICAL FLUID COMPOSITIONS

(75) Inventors: John C. Ulicny, Oxford, MI (US); Yang-Tse Cheng, Rochester Hills, MI (US); Mark A. Golden, Washington, MI (US); Keith S. Snavely, Sterling Heights, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 369 days.

(21) Appl. No.: 11/202,414

(22) Filed: Aug. 11, 2005

(65) Prior Publication Data

US 2006/0033069 A1 Feb. 16, 2006

Related U.S. Application Data

(60) Provisional application No. 60/601,574, filed on Aug. 13, 2004.

(51) Int. Cl.
*H01F 1/44* (2006.01)

(52) U.S. Cl. ..... 252/62.52

(58) Field of Classification Search ..... 252/62.52
See application file for complete search history.

(56) References Cited

U.S. PATENT DOCUMENTS 5,505,880 A * 4/1996 Kormann et al. ..... 252/62.54
5,525,249 A * 6/1996 Kordonsky et al. ..... 252/62.56
5,906,767 A 5/1999 Karol et al. ..... 252/62.52
5,989,447 A * 11/1999 Podszun et al. ..... 252/62.52
6,132,633 A 10/2000 Carlson ..... 252/65.52
6,203,717 B1 3/2001 Munoz et al. ..... 252/62.52
6,475,404 B1 11/2002 Carlson ..... 252/62.62
6,547,986 B1 4/2003 Kintz et al. ..... 252/62.52
6,611,185 B2 8/2003 Carlson et al. ..... 335/207
6,695,102 B1 2/2004 Marjoram et al. ..... 188/267.2
7,007,972 B1 * 3/2006 Radhakrishnan et al. .... 280/736
2003/0071238 A1 4/2003 Kintz et al. ..... 252/62.52

OTHER PUBLICATIONS

R.C. Kanu et al; "Effects of DC and AC Electric Fields on the Response of Electrorheological Fluids Conprising Cylindrical PBZT Particles"; Progress in Electrorheology; K.O. Havelka and F.E. Filisko, eds., Plenum, NY, 1995 pp. 303-323.

R.C. Kanu et al; "Studies of ER Fluids Featuring Rodlike Particles"; Int. J. Mod. Phys. B, vol. 10, 2925-2932 (1996).

* cited by examiner

*Primary Examiner*—C. Melissa Koslow

(57) ABSTRACT

A magnetorheological fluid composition comprising a carrier fluid; and a plurality of high aspect ratio magnetizable particles, wherein the aspect ratio of the high aspect ratio magnetizable particles is greater than 1.5. Optionally, the high aspect ratio magnetizable particles can have interlocking structures comprising male component and a female component. Still further, a magnetorheological fluid composition can comprise low aspect ratio magnetizable particles having the interlocking structures, wherein the aspect ratio of the low aspect ratio magnetizable particles is 1 to 1.5.

19 Claims, 3 Drawing Sheets

MAGNETORHEOLOGICAL FLUID COMPOSITIONS

CROSS REFERENCE TO RELATED APPLICATIONS

The present application relates to and claims priority to U.S. Provisional Application No. 60/601,574 filed on Aug. 13, 2004, incorporated herein by reference in its entirety.

BACKGROUND

This disclosure generally relates to magnetorheological fluid compositions, and more particularly, to magnetorheological fluid compositions comprising high aspect ratio magnetizable particles.

Fluid compositions that undergo a change in apparent viscosity in the presence of a magnetic field are referred to as Bingham magnetic fluids or magnetorheological fluids. These magnetorheological fluids generally include magnetizable particles dispersed or suspended within a carrier fluid. In the presence of a magnetic field, the magnetizable particles become polarized and are thereby organized into chains of particles within the carrier fluid. The chains of particles act to increase the apparent viscosity or flow resistance of the fluid composition resulting in the development of a solid mass having a yield stress that must be exceeded to induce onset of flow of the magnetorheological fluid. When the flow of the fluid composition is restricted as a result of orientation of the particles into chains, the fluid composition is said to be in its "on state". The force required to exceed the yield stress is referred to as the "yield strength". In the absence of a magnetic field, the particles return to an unorganized or free state and the apparent viscosity or flow resistance of the fluid composition is then correspondingly reduced. The state occupied by the composition in the absence of a magnetic field is referred to as the "off-state".

Commonly used magnetorheological fluids generally employ magnetizable particles that are symmetrical and have aspect ratios of about 1 to about 1.5. Examples of such particles are spherical particles, ellipsoids, cuboids, or the like. Magnetorheological fluids employing the aforementioned particles are typically used in dampers, clutches, and other torque transfer devices. In these applications, however, the magnetorheological fluid can be subjected to high shear forces causing extreme wear on the magnetizable particles. As a result of this wear, the magnetorheological fluid thickens substantially over time, leading to an increasing off-state viscosity. The increasing off-state viscosity leads to an increase in off-state force experienced by the piston or rotor. This increase in off-state force hampers the freedom of movement of the piston or rotor in certain off-state conditions.

In a magnetorheological device, it is often desirable to maximize the ratio of the on-state force to the off-state force in order to maximize the controllability offered by the device. Since the on-state force is dependent upon the magnitude of the applied magnetic field and the MR fluid composition, the on-state force should remain constant at any given applied magnetic field. If the off-state force increases over time because the off-state viscosity is increasing but the on-state force remains constant, the on-state/off-state ratio will decrease. This decrease in the on-state/off-state ratio results in undesirable minimization of the controllability offered by the device. A more durable magnetorheological fluid that does not thicken over an extended period of time, preferably over the life of the device would be very useful.

SUMMARY

Disclosed herein is a magnetorheological fluid composition comprises a carrier fluid; and a plurality of low aspect ratio magnetizable particles with interlocking structures. In one embodiment, the composition further includes high aspect ratio magnetizable particles. The high aspect ratio magnetizable particles may include the interlocking structures.

In another embodiment, the magnetorheological fluid composition comprises a carrier fluid; and a plurality of high aspect ratio magnetizable particles.

In yet another embodiment, the magnetorheological fluid composition comprises a carrier fluid; a plurality of high aspect ratio magnetizable particles having an aspect ratio greater than 1.5; and a plurality of low aspect ratio magnetizable particles with interlocking structures, wherein the low aspect ratio magnetizable particles have an aspect ratio from 1 to 1.5.

The above described and other features are exemplified by the following figures and detailed description.

Figure 1:
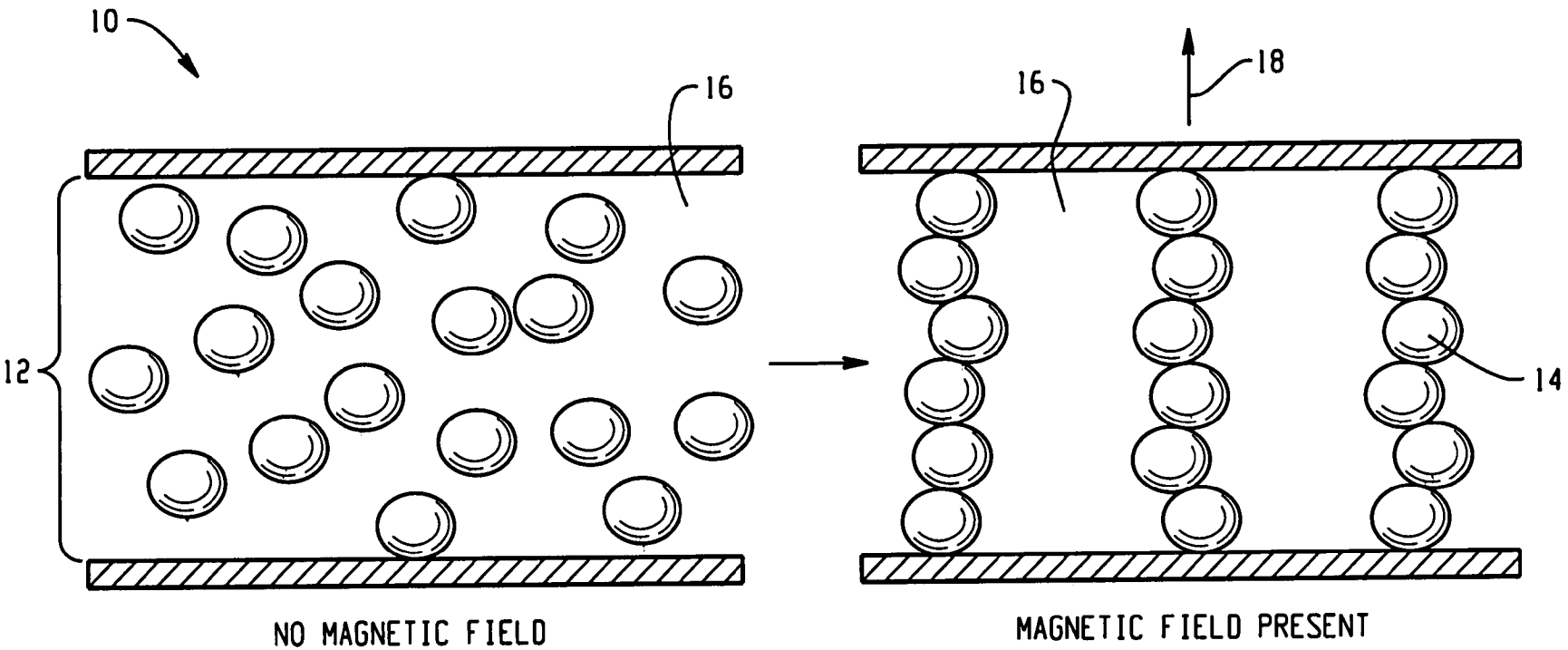
Fig. 1 PRIOR ART
FIG. 1 is a prior art schematic of an MR device including low aspect ratio particles that form chains upon the application of a magnetic field.

The above described and other features are exemplified by the following figures and detailed description.

DETAILED DESCRIPTION

Disclosed herein are magnetorheological (MR) fluid compositions that comprise magnetizable particles. In one embodiment, the magnetizable particles have a high aspect ratio, wherein the term high aspect ratio refers to an aspect ratio greater than 1.5. For a three dimensional particle, the aspect ratio is the ratio of the largest dimension to the smallest dimension. The high aspect ratio magnetizable particles will align with an applied magnetic field and when the applied field is perpendicular to the flow direction, the alignment of the magnetized particles promotes an increase in viscosity. In contrast, alignment of the high aspect ratio particles in the flow direction will promote a decrease in viscosity. This functionality of high aspect ratio particles causes MR fluid compositions containing them to be different from MR fluid compositions that contain low aspect ratio particles, for example. Low aspect ratio particles as defined herein have an aspect ratio of about 1 to 1.5.

The primary advantage of MR fluid compositions containing the high aspect ratio particles is that the yield stress of the MR fluid composition can be 2 to 10 times higher when compared with MR fluid compositions containing low aspect ratio particles alone. This feature, in turn, will allow the production of MR fluid devices that are smaller but produce the same level of force as produced by larger devices that contain MR fluids with only low aspect ratio particles. Thus, MR fluids containing high aspect ratio particles can thus be used to build devices that are either more powerful and/or smaller than those devices that use MR fluids with only low aspect ratio particles. To obtain these benefits, the MR fluid can consist essentially of high aspect ratio particles or may contain a mixture of high aspect and low aspect ration particles. Also, it should be noted that since high aspect particles will align themselves with the flow field in shear when no magnetic field is present, MR fluid compositions containing high aspect particles will exhibit lower apparent viscosities as compared to compositions containing only low aspect ratio particles.

Upon alignment, the high aspect ratio particles form chains or networks of high aspect ratio particles whose orientation facilitates an increase in viscosity. Further, a decrease in viscosity is also advantageously achieved upon removal of the magnetic field as the high aspect ratio particles align when sheared. Because of their geometry, the use of high aspect ratio particles permits the use of a smaller number of total magnetizable particles in the MR fluid composition when compared with a MR fluid composition that contains only low aspect ratio particles. Since the increase in viscosity can be achieved with a smaller number of magnetizable particles, MR devices containing the MR fluid composition can be reduced in size when compared with devices that contain MR fluid compositions that contain only low aspect ratio particles.

In one embodiment, the MR fluid composition comprises particles that are provided with reversible interlocking structures. These reversible interlocking structures produce higher strength chains or networks upon alignment when compared with chains or networks that are formed from particles that are not provided with such interlocking structures. The particles that contain the interlocking structures can have high aspect ratios (i.e., have an aspect ratio that is greater than 1.5) or alternatively can be low aspect ratios (i.e., have an aspect ratio that is less than or equal to 1.5).

With reference now to FIG. 1, a prior art MR fluid device 10 contains an MR fluid composition 12 that contains only low aspect ratio particles 14 disposed within a carrier fluid 16. The low aspect ratio particles are depicted as being spherically shaped, thus having an aspect ratio of about 1. As can be seen in FIG. 1, the low aspect ratio particles 14 are randomly distributed in the carrier fluid 16 in the absence of a magnetic field. Upon application of a magnetic field 18, the low aspect ratio particles form chains with an alignment that is dependent upon the strength and direction of the applied magnetic field. An arrow shows the direction of the applied magnetic field. The formation of the chains promotes an increase in viscosity, and this increase in viscosity can be used for braking, clutching, shock absorption, damping, mounting, or the like, in vehicles or similar devices, and machinery.

Figure 2:
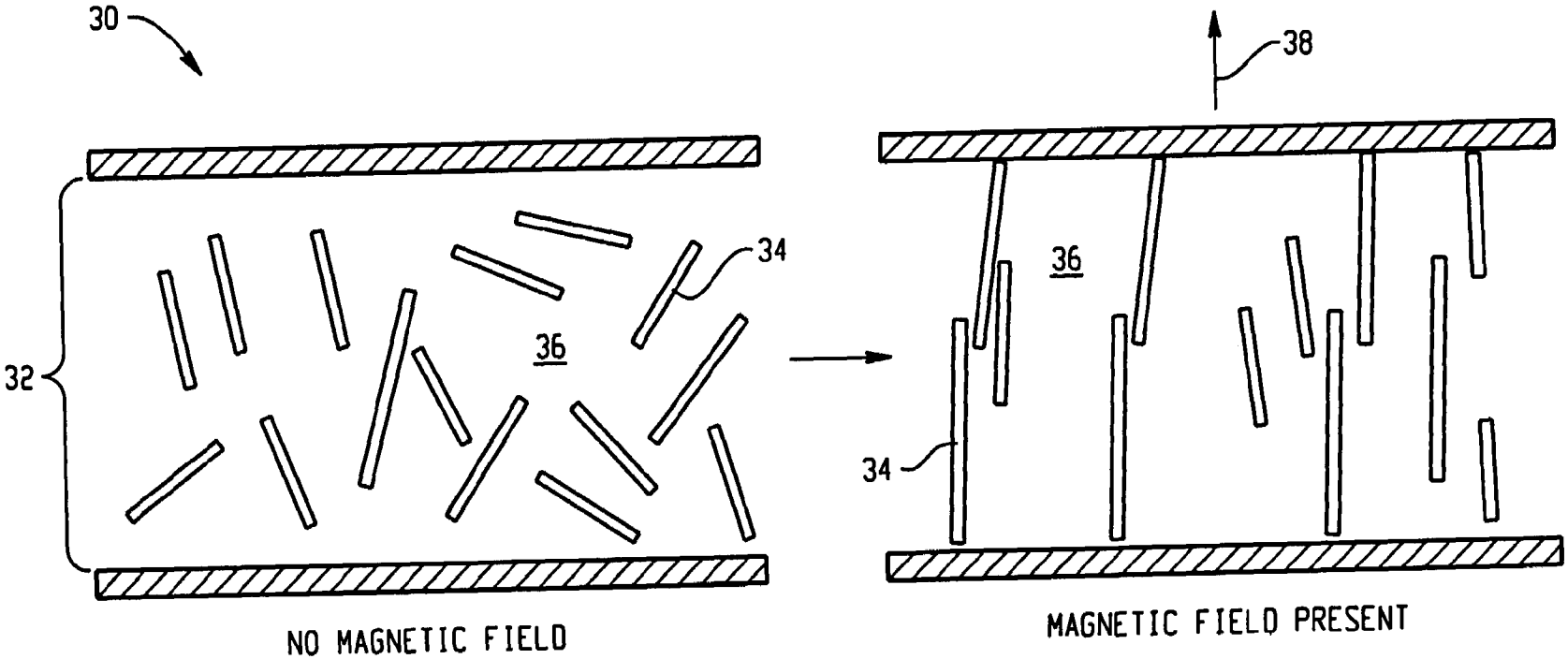
FIG. 2 is a depiction of an exemplary embodiment showing the formation of a network when high aspect ratio particles such as wires are used in a MR fluid composition.

FIG. 2 depicts an exemplary embodiment, wherein the MR device 30 includes an MR fluid composition 32 comprises high aspect ratio particles 34 disposed within a carrier fluid 36. As can be seen in FIG. 2, the high aspect ratio particles 34 are randomly aligned when no magnetic field is applied. However, upon application of a magnetic field, the high aspect ratio particles 34 become aligned within the carrier fluid 36 in the direction of the applied magnetic field 38. The orientation of the high aspect ratio particles is dependent upon the strength and direction of the applied magnetic field. Upon applying the magnetic field perpendicular to the flow direction, the high aspect ratio particles undergo an orientation (packing) that produces a higher yield stress (higher apparent viscosity) as compared to low aspect ratio particles of similar volume concentration. When the applied magnetic field is parallel to the flow direction, the yield stress can be lower than that produced by low aspect ratio particles of a similar volume concentration.

In one embodiment, viscosity control of a MR fluid composition can also be adjusted by using high aspect ratio particles that have different shapes. For example, the high aspect ratio particles can be linear, curled, crimped, bent, twisted, or have any combination that comprises at least one of the foregoing shapes.

As noted above, the high aspect ratio particles as well as the low aspect ratio particles can be provided with reversible interlocking structures. The reversible interlocking structures generally comprise a male component and a female component. The male component is generally accepted into the female component, thereby facilitating the interlocking. The male interlocking structures generally are shaped in the form of protrusions on the surface of the magnetizable particles. Examples of suitable male interlocking structures are hooks, spikes, fins, teeth, or the like. Examples of suitable female interlocking structures are holes, pores, notches, grooves, or the like. Any magnetizable particle having an interlocking structure may have a male component, such as one or more of the above described male interlocking structures; or a female component adapted to receive a male component, such as one or more of the above described female interlocking structures; or a combination of male and female components. Thus, a magnetorheological fluid composition is formulated to provide magnetizable particles that are distributed in a carrier fluid and have complementary male and female interlocking structures, on different particles or the same particles, which structures can interlock upon the application of a magnetic field and increase the viscosity of the fluid.

As noted above, the particles provided with the interlocking structures can have high aspect ratios or low aspect ratios. When combinations of high and low aspect ratio particles are used, the particles may or may not have interlocking capabilities. The proportions of high aspect ratio magnetizable particles and low aspect ratio magnetizable particles with interlocking structures include weight ratios from about 1:100 to about 100:1.

It is generally desirable to have a ratio of male interlocking structures to female interlocking structures to be about 1:1 to about 1:100. A suitable example of a magnetizable particle that has a 1:1 ratio of male interlocking to female interlocking structures is a fishbone. An example of a magnetizable particle having a large number of female interlocking structures is one that has a porous surface. A single particle can have both, male, as well as female interlocking structures, though it is generally desirable to have a higher proportion of female to male interlocking structures. Having a high ratio of female to male interlocking structures would facilitate ease of interlocking. In addition, it is desirable to have the female interlocking structures spaced sufficiently far apart from each other on any given particle so as to not to serve as an obstruction to any other male interlocking structure. In order to facilitate reversible interlocking, it is desirable that the female structures have a larger inner diameter than the outer diameter of the corresponding male interlocking structure. This will facilitate ease of interlocking as well as minimize friction during the process of unlocking.

Figure 3:
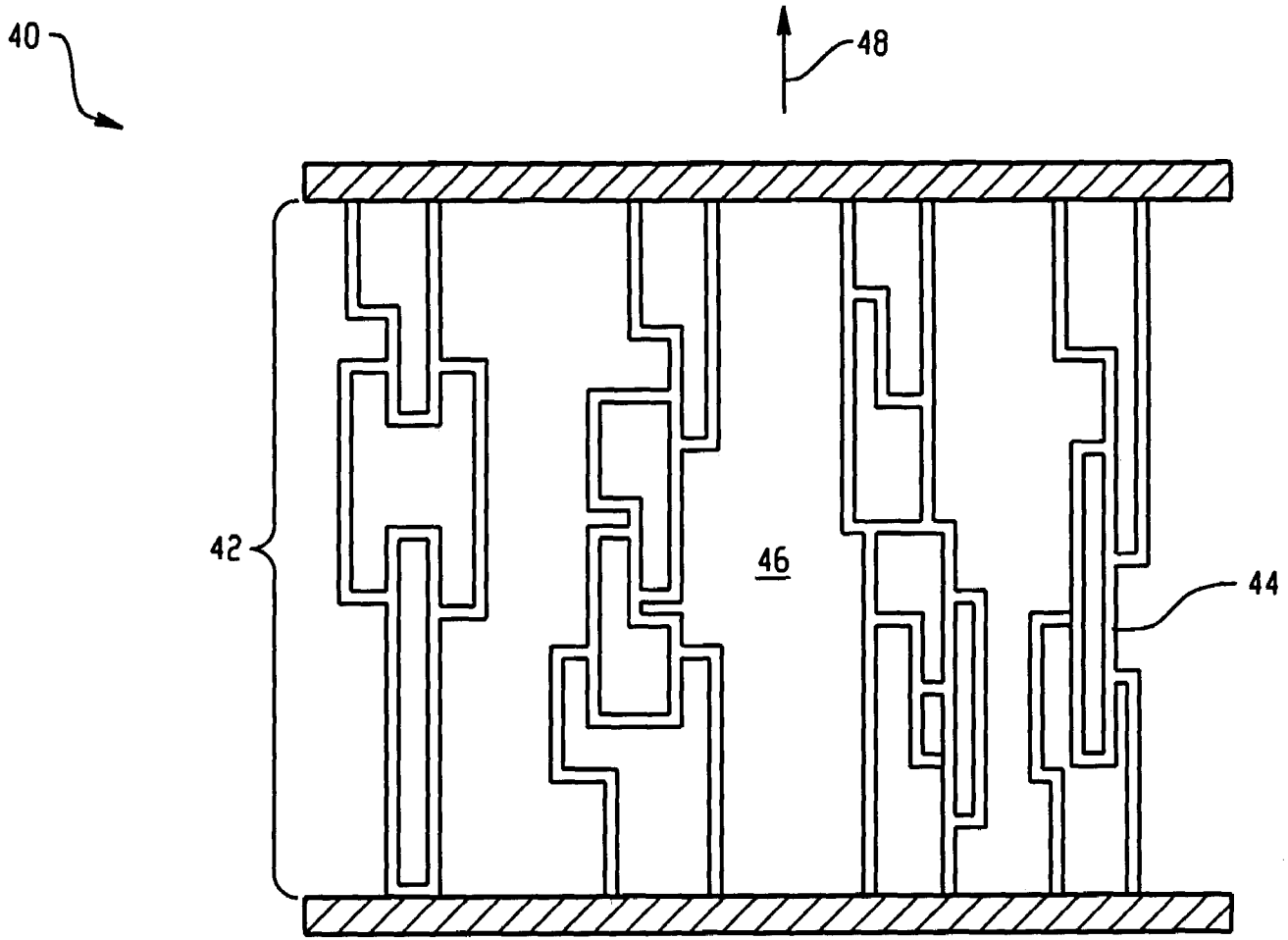
FIG. 3 is a depiction of another exemplary embodiment where the MR fluid composition contains high aspect ratio magnetized particles that can interlock upon the application of a magnetic field.

FIG. 3 reflects an exemplary embodiment, wherein the illustrated MR device 40 includes an MR fluid composition 42 comprising high aspect ratio particles 44 with male and female interlocking structures disposed within a carrier fluid 46. The high aspect ratio particles form a percolating network of interlocking magnetized particles upon the application of the magnetic field 48. As can be seen in the FIG. 3, the particles are interlocked into a chain, thereby providing greater rigidity. The male interlocking structure mates with an appropriate female interlocking structure thereby forming a chain or a network. It should be noted that the MR fluid composition may further include low aspect ratio particles with or without interlocking structures. Also, the MR fluid composition may consist of low aspect ratio particles with at least a portion having the interlocking structures.

In one embodiment, the network of magnetized particles can form a percolating network, i.e., there is at least one continuous path of magnetized particles that traverses at least one dimension of the device housing depending on the direction of the applied magnetic signal, e.g., the diameter of a cylindrically shaped device housing. In another embodiment, the network is a non-percolating network.

When high aspect ratio particles are used, discrete or percolating networks of magnetized particles can be formed in the MR fluid composition upon the removal of the magnetic field.

The MR fluid composition generally comprises magnetizable particles, a carrier fluid and optionally additives The magnetizable particles of the MR fluid composition are comprised of, for example, paramagnetic, superparamagnetic, ferromagnetic compounds, or a combination comprising at least one of the foregoing compounds. Examples of specific magnetizable particles are particles comprised of materials such as iron, iron oxide, iron nitride, iron carbide, carbonyl iron, chromium dioxide, low carbon steel, silicon steel, nickel, cobalt, or the like, or a combination comprising at least one of the foregoing. The iron oxide includes all forms of pure iron oxide, such as, for example, $Fe_2O_3$ and $Fe_3O_4$, as well as those containing small amounts of other elements, such as, manganese, zinc or barium. Specific examples of iron oxide include ferrites and magnetites. In addition, the magnetizable particles can be comprised of alloys of iron, such as, for example, those containing aluminum, silicon, cobalt, nickel, vanadium, molybdenum, chromium, tungsten, manganese, copper, or a combination comprising at least one of the foregoing metals.

The magnetizable particles can also be comprised of specific iron-cobalt and iron-nickel alloys. The iron-cobalt alloys have an iron to cobalt ratio ranging from about 30:70 to about 95:5. In one embodiment, the iron-cobalt alloys can have an iron to cobalt ratio ranging from about 50:50 to about 85:15. The iron-nickel alloys have an iron to nickel ratio ranging from about 90:10 to about 99:1. In one embodiment, the iron-nickel alloys can have an iron to cobalt ratio ranging from about 94:6 to about 97:3.

The aforementioned iron-cobalt and iron-nickel alloys may also contain a small amount of additional elements, such as, for example, vanadium, chromium, or the like, in order to improve the ductility and mechanical properties of the alloys. These additional elements are typically present in an amount that is less than about 3.0% by weight, based on the total weight of the magnetizable particles.

The magnetizable particles are generally obtained from processes involving the reduction of metal oxides, grinding or attrition, electrolytic deposition, metal carbonyl decomposition, rapid solidification, or smelt processing. Examples of suitable metal powders that are commercially available are straight iron powders, reduced iron powders, insulated reduced iron powders, cobalt powders, or the like, or a combination comprising at least one of the foregoing metal powders. Alloy powders can also be used. A suitable example of an alloy powder is one comprising 48 wt % iron, 50 wt % cobalt and 2 wt % vanadium from UltraFine Powder Technologies, for example.

Exemplary magnetizable particles are those that contain a majority of iron in any one of its chemically available forms. Carbonyl iron powders that are made by the thermal decomposition of iron pentacarbonyl are generally desirable for use in a MR fluid composition.

The low aspect ratio magnetizable particles with interlocking structures have a low aspect ratio of 1 to 1.5. An exemplary low aspect ratio particle is one that has an aspect ratio of about 1. Examples of suitable low aspect ratio particles that have interlocking structures are spherical particles ellipsoidal particles, conical particles, cuboidal particles, polygonal particles, or the like. The low aspect ratio magnetizable particles with interlocking structures generally have an average particle size of about 0.1 micrometers to about 500 micrometers. In one embodiment, the low aspect ratio magnetizable particles have an average particle size of about 1 micrometers to about 250 micrometers. In another embodiment, the low aspect ratio magnetizable particles have an average particle size of about 10 micrometers to about 100 micrometers. In yet another embodiment, the low aspect ratio magnetizable particles have an average particle size of about 20 micrometers to about 80 micrometers. The low aspect ratio magnetizable particles with interlocking structures may have a bimodal or high particle size distributions. While not wanting to be bound by theory, it is believed the use of bimodal particle size distribution can provide MR fluids with lower off-states relative to particles having a single size distribution (applicable to high aspect ratio particles as well as low aspect ratio particles).

The high aspect ratio magnetizable particles are those having an aspect ratio of greater than 1.5. These high aspect ratio magnetizable particles may therefore exist in the form of whiskers, needles, rods, tubes, strands, elongated platelets, lamellar platelets, ellipsoids, wires, micro fibers, nanofibers and nanotubes, elongated fullerenes, or the like, or a combination comprising at least one of the foregoing. The high aspect ratio magnetizable particles may also have shapes that are combinations of the shapes of high aspect ratio particles and low aspect ratio particles. For example, a suitable example of a high aspect ratio magnetizable particle that has a combined shape is one where a spherical particle is disposed upon a high aspect ratio magnetizable particle, at any point along the length of the high aspect ratio particle. In one embodiment, where such magnetizable particles exist in aggregate form, an aggregate having an aspect ratio greater than 1.5 will also suffice.

In general the high aspect ratio magnetizable particles can have cross sections that have any desirable geometry. Examples of suitable geometries are square, rectangular, triangular, circular, elliptical, polygonal, or a combination comprising at least one of the foregoing geometries.

The high aspect ratio particles can be nanoparticles or particles having dimensions in the micrometer range. High aspect ratio nanoparticles are those having at least one average dimension that is less than or equal to about 1,000 nanometers. A suitable example of a nanoparticle is one having an average diameter size of less than or equal to about 500 nanometers. In one embodiment, it is desirable for the high aspect ratio nanoparticles to have at least one average dimension that is less than or equal to about 200 nanometers. In another embodiment, it is desirable for the high aspect ratio nanoparticles to have at least one average dimension that is less than or equal to about 100 nanometers. In yet another embodiment, it is desirable for the high aspect ratio nanoparticles to have at least one average dimension that is less than or equal to about 25 nanometers.

Micrometer sized high aspect ratio magnetizable particles are those having the smallest dimension greater than about 1 micrometer. In one embodiment, micrometer sized high aspect ratio magnetizable particles are those having the smallest dimension greater than or equal to about 10 micrometers. In another embodiment, micrometer sized high aspect ratio magnetizable particles are those having the smallest dimension greater than or equal to about 100 micrometers. In yet another embodiment, micrometer sized high aspect ratio magnetizable particles are those having the smallest dimension greater than or equal to about 1,000 micrometers.

As previously noted, the aspect ratio of the high aspect ratio magnetizable particles is greater than 1.5. In one embodiment, the aspect ratio of the high aspect ratio magnetizable particles is greater than 2. In another embodiment, the aspect ratio of the high aspect ratio magnetizable particles is greater than 5. In yet another embodiment, the aspect ratio of the high aspect ratio magnetizable particles is greater than 10. In yet another embodiment, the aspect ratio of the high aspect ratio magnetizable particles is greater than 100. In yet another embodiment, the aspect ratio of the high aspect ratio magnetizable particles is greater than 1,000. In yet another embodiment, the aspect ratio of the high aspect ratio magnetizable particles is greater than 10,000.

The number of magnetizable particles in the MR fluid composition generally depends upon the desired magnetic activity and viscosity of the fluid, but can be from about 0.01 to about 60 volume percent of the carrier fluid, based on the total volume of the MR fluid composition. In one embodiment, the number of magnetizable particles in the MR fluid composition can be from about 1.5 to about 50 volume percent, based on the total volume of the MR fluid composition.

The carrier fluid forms the continuous phase of the MR fluid composition. Examples of suitable carrier fluids are natural fatty oils, mineral oils, poly α-olefins, polyphenylethers, polyesters (such as perfluorinated polyesters, dibasic acid esters and neopentylpolyol esters), phosphate esters, synthetic cycloparaffin oils and synthetic paraffin oils, unsaturated hydrocarbon oils, monobasic acid esters, glycol esters and ethers (such as polyalkylene glycol), synthetic hydrocarbon oils, perfluorinated polyethers, halogenated hydrocarbons, or the like, or a combination comprising at least one of the foregoing carrier fluids.

Exemplary carrier fluids are those which are non-volatile, non-polar and do not contain amounts of water greater than or equal to about 5 wt %, based upon the total weight of the carrier fluid. Examples of hydrocarbons are mineral oils, paraffins, or cycloparaffins. Synthetic hydrocarbon oils include those oils derived from oligomerization of olefins such as polybutenes and oils derived from high molecular weight alpha olefins having about 8 to about 20 carbon atoms by acid catalyzed dimerization and by oligomerization using trialuminum alkyls as catalysts.

The carrier fluid is generally present in an amount of about 40 to about 99.999 volume percent, based upon the total volume of the MR fluid composition. In one embodiment, the carrier fluid is generally present in an amount ranging from about 50 to about 99 volume percent, based upon the total volume of the MR fluid composition.

The MR fluid composition can optionally include other additives such as a thixotropic agent, a carboxylate soap, an antioxidant, a lubricant, a viscosity modifier, a sulfur-containing compound or a combination comprising at least one of the foregoing additives. If present, these optional additives can be present in an amount of about 0.25 to about 10 volume percent, based upon the total volume of the magnetorheological fluid. In one embodiment, these optional additives can be present in an amount of about 0.5 to about 7.5 volume percent, based upon the total volume of the magnetorheological fluid.

Exemplary thixotropic agents include polymer-modified metal oxides. The polymer-modified metal oxide can be prepared by reacting a metal oxide powder with a polymeric compound that is compatible with the carrier fluid and capable of shielding substantially all of the hydrogen-bonding sites or groups on the surface of the metal oxide from any interaction with other molecules. Examples of suitable metal oxide powders include precipitated silica gel, fumed or pyrogenic silica, silica gel, titanium dioxide, and iron oxides such as ferrites or magnetites, or the like, or a combination comprising at least one of the foregoing metal oxide powders.

Examples of suitable polymeric compounds useful in forming the polymer-modified metal oxides include thermosetting polymers, thermoplastic polymers or combinations of thermosetting polymers with thermoplastic polymers. Examples of polymeric compounds are oligomers, polymers, copolymers such as block copolymers, star block copolymers, terpolymers, random copolymers, alternating copolymers, graft copolymers, or the like, dendrimers, ionomers, or the like, or a combination comprising at least one of the foregoing. Examples of suitable polymers are polyacetals, polysiloxanes, polyurethanes, polyolefins, polyacrylics, polycarbonates, polyalkyds, polystyrenes, polyesters, polyamides, polyaramides, polyamideimides, polyarylates, polyarylsulfones, polyethersulfones, polyphenylene sulfides, polysulfones, polyimides, polyetherimides, polytetrafluoroethylenes, polyetherketones, polyether etherketones, polyether ketone ketones, polybenzoxazoles, polyoxadiazoles, polybenzothiazinophenothiazines, polybenzothiazoles, polypyrazinoquinoxalines, polypyromellitimides, polyquinoxalines, polybenzimidazoles, polyoxindoles, polyoxoisoindolines, polydioxoisoindolines, polytriazines, polypyridazines, polypiperazines, polypyridines, polypiperidines, polytriazoles, polypyrazoles, polycarboranes, polyoxabicyclononanes, polydibenzofurans, polyphthalides, polyacetals, polyanhydrides, polyvinyl ethers, polyvinyl thioethers, polyvinyl alcohols, polyvinyl ketones, polyvinyl halides, polyvinyl nitriles, polyvinyl esters, polysulfonates, polysulfides, polythioesters, polysulfones, polysulfonamides, polyureas, polyphosphazenes, polysilazanes, polysiloxanes, phenolics, epoxies, or combinations comprising at least one of the foregoing organic polymers.

Examples of the carboxylate soap include lithium stearate, calcium stearate, aluminum stearate, ferrous oleate, ferrous stearate, zinc stearate, sodium stearate, strontium stearate, or the like, or a combination comprising at least one of the foregoing carboxylate soaps.

Examples of sulfur-containing compounds include thioesters such as tetrakis thioglycolate, tetrakis(3-mercaptopropionyl) pentaerithritol, ethylene glycoldimercaptoacetate, 1,2,6-hexanetriol trithioglycolate, trimethylol ethane tri(3-mercaptopropionate), glycoldimercaptopropionate, bisthioglycolate, trimethylolethane trithioglycolate, trimethylolpropane tris(3-mercaptopropionate) and similar compounds and thiols such as 1-dodecylthiol, 1-decanethiol, 1-methyl-1-decanethiol, 2-methyl-2-decanethiol, 1-hexadecylthiol, 2-propyl-2-decanethiol, 1-butylthiol, 2-hexadecylthiol, or the like, or a combination comprising at least one of the foregoing sulfur-containing compounds.

The viscosity of the MR fluid composition is generally dependent upon the specific use to which it is applied. In general, it is desirable for the MR fluid composition having high aspect ratio particles to have a viscosity of about 1 to about 1,000 centipoise at 40° C. in the off-state. In one embodiment, it is desirable for the MR fluid composition having high aspect ratio particles to have a viscosity of about 10 to about 700 centipoise at 40° C. in the off-state. In yet another embodiment, it is desirable for the MR fluid composition having high aspect ratio particles to have a viscosity of about 50 to about 600 centipoise at 40° C. in the off-state. In yet another embodiment, it is desirable for the MR fluid composition having high aspect ratio particles to have a viscosity of about 90 to about 400 centipoise at 40° C. in the off-state. In the case of the interlocking magnetizable particles the foregoing viscosity ranges would be applicable in the off-state.

In general, it is desirable for the MR fluid composition having high aspect ratio particles to have a viscosity of about 50 to about 500 centipoise at 40° C. in the off-state. In one embodiment, it is desirable for the MR fluid composition having high aspect ratio particles to have a viscosity of about 10 to about 200 centipoise at 40° C. in the off-state. In yet another embodiment, it is desirable for the MR fluid composition having high aspect ratio particles to have a viscosity of about 5 to about 100 centipoise at 40° C. in the off-state. On-state yield stresses for MR fluid compositions that contain high aspect ratio particles are about 100 to about 1000 kilopascals (about 15 to about 150 pound per square inch) or about 1 to about 10 times the yield stresses available from MR fluid compositions containing only low aspect ratio particles. These yield stresses would be measured at magnetic flux densities on the order of about 1 to about 2 tesla (i.e., when the particles are magnetically saturated).

In one embodiment, in one method of manufacturing the MR fluid composition, the low aspect ratio interlocking particles and/or the high aspect ratio particles (which can optionally be interlocking), the carrier fluid and desired additives are taken and mixed in a suitable mixing device to form a suitable mixture. If desired, the mixing may be conducted at an elevated temperature of greater than or equal to about 50° C. The mixing can take place in a device that uses shear force, extensional force, compressive force, ultrasonic energy, electromagnetic energy, thermal energy or combinations comprising at least one of the foregoing forces and energies and is conducted in processing equipment wherein the aforementioned forces are exerted by a single screw, multiple screws, intermeshing co-rotating or counter rotating screws, non-intermeshing co-rotating or counter rotating screws, reciprocating screws, screws with pins, barrels with pins, screen packs, rolls, rams, helical rotors, or combinations comprising at least one of the foregoing.

Exemplary mixing devices are extruders such as single screw and twin screw extruders, buss kneaders, helicones, ball mixers, Eirich mixers, Waring blenders, Henschel mixers, or the like.

In one embodiment related to the use of the magnetorheological fluid, a method of operating a magnetorheological device comprises applying a magnetic field to the magnetorheological fluid and thereby polarizing the interlocking particles to align and form a chain. As detailed above, the aligning promotes the formation of a network of interconnected chains. In one embodiment, the networks are percolating networks. In another embodiment, the networks are non-percolating networks.

In another embodiment, the removal of a magnetic field that has been applied to a magnetorheological fluid causes high aspect ratio particles contained in the fluid to orient randomly, thereby increasing the viscosity. In yet another embodiment, a method of operating a magnetorheological device comprises applying a magnetic field to the magnetorheological fluid and thereby polarizing the high aspect ratio particles to align thereby facilitating a decrease in the viscosity.

The magnetorheological fluid can be advantageously used in any controllable device such as dampers, mounts, clutches, brakes, valves and similar devices. The fluid is particularly suitable for use in devices that require exceptional durability such as dampers.

While the disclosure has been described with reference to exemplary embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the invention not be limited to the particular embodiment disclosed as the best mode contemplated for carrying out this disclosure.

What is claimed is:

1. A magnetorheological fluid composition comprising:

a carrier fluid; and a plurality of low aspect ratio magnetizable particles with interlocking structures.

2. The composition of claim 1, further comprising a plurality of high aspect ratio magnetizable particles.

3. The composition of claim 2, wherein a plurality of high aspect ratio magnetizable particles have interlocking structures.

4. The composition of claim 3, wherein individual magnetizable particles comprising an interlocking structure comprise a male component, or a female component adapted to receive the male component, or a combination of the male and female components such that the interlocking structures of the respective magnetizable particles collectively comprise male components and female components at a ratio of 1:1 to about 1:100.

5. The composition of claim 1, further comprising an additive, the additive comprising a thixotropic agent, a carboxylate soap, an antioxidant, a lubricant, a viscosity modifier, a sulfur-containing compound or a combination comprising at least one of the foregoing additives in an amount of about 0.25 to about 10 volume percent, based upon the total volume of the magnetorheological fluid composition.

6. The composition of claim 4, wherein the male component comprises hooks, spikes, fins, teeth, or a combination comprising at least one of the foregoing projecting from a surface of the low aspect or the high aspect ratio magnetizable particles and wherein the female component comprises holes, pores, notches, grooves, or a combination comprising at least one of the foregoing within the surface of the low aspect or the high aspect ratio magnetizable particles.

7. The composition of claim 1, wherein the plurality of low aspect ratio magnetizable particles with interlocking structures comprise a spherical shape, an ellipsoidal shape, a conical shape, a cuboidal shape, or a polygonal shape.

8. The composition of claim 1, wherein the plurality of the low aspect ratio magnetizable particles with interlocking structures has a bimodal or higher particle size distribution.

9. The composition of claim 2, wherein the high aspect ratio magnetizable particles comprise whiskers, needles, rods, tubes, strands, elongated platelets, lamellar platelets, ellipsoids, wires, micro fibers, nanofibers, nanotubes, elongated fullerenes, or combinations comprising at least one of the foregoing.

10. The composition of claim 2, wherein the high aspect ratio magnetizable particles can be nanoparticles that have at least one average dimension that is less than or equal to about 1,000 nanometers.

11. The composition of claim 2, wherein the high aspect ratio magnetizable particles and the low aspect ratio magnetizable particles with interlocking structures are manufactured from iron, iron oxide, iron nitride, iron carbide, carbonyl iron, chromium dioxide, low carbon steel, silicon steel, nickel, cobalt, iron oxides that contain small amounts of manganese, zinc or barium; alloys of iron that contain aluminum, silicon, cobalt, nickel, vanadium, molybdenum, chromium, tungsten, manganese, copper, or a combination comprising at least one of the foregoing metals; iron-cobalt alloys having an iron to cobalt ratio ranging from about 30:70 to about 95:5; iron-nickel alloys having an iron to nickel ratio ranging from about 90:10 to about 99:1; or a combination comprising at least one of the foregoing.

12. The composition of claim 2, wherein the high aspect ratio magnetizable particles and the low aspect ratio magnetizable particles with interlocking structures are at a weight ratio of about 1:100 to about 100:1.

13. The composition of claim 1, wherein the carrier fluid is an amount of about 40 to about 99.999 volume percent based upon the total volume of the magnetorheological fluid composition.

14. The composition of claim 1, wherein the composition has a viscosity of about 1 to about 1,000 centipoise at 40° C. in an off-state.

15. A magnetorheological fluid composition comprising:

a carrier fluid; and a plurality of high aspect ratio magnetizable particles comprising interlocking structures.

16. The composition of claim 15, wherein the interlocking structures comprise a male component and a female component at a ratio of 1:1 to about 1:100.

17. The composition of claim 15, further comprising low aspect ratio magnetizable particles.

18. The composition of claim 15, further comprising low aspect ratio magnetizable particles comprising interlocking structures.

19. The composition of claim 15, wherein the plurality of the high aspect ratio magnetizable particles with interlocking structures has a bimodal or a higher particle size distribution.

* * * * *